US005994851A

United States Patent [19]

Kim

[11] Patent Number: 5,994,851

[45] Date of Patent: Nov. 30, 1999

[54] FOCUSING ELECTRODE SYSTEM HAVING BURRING PARTS OF DIFFERING SIZES

[75] Inventor: Hyun Cheol Kim, Kyungsangbuk-do, Rep. of Korea

[73] Assignee: LG Electronics, Inc., Seoul, Rep. of Korea

[21] Appl. No.: 08/965,667

[22] Filed: Nov. 6, 1997

[30] Foreign Application Priority Data

Nov. 6, 1996 [KR] Rep. of Korea ..... 96/52228

[51] Int. Cl.[6] ..... H01J 29/51; H01J 29/46

[52] U.S. Cl. ..... 315/382; 315/382.1; 313/414

[58] Field of Search ..... 315/382, 382.1, 315/368.15; 313/414, 446, 447

[56] References Cited

U.S. PATENT DOCUMENTS

| | | | |
|---|---|---|---|
| 4,772,826 | 9/1988 | Bloom et al. | 315/368.15 |
| 4,887,009 | 12/1989 | Bloom et al. | 315/368.15 |
| 5,512,797 | 4/1996 | Kim et al. | 313/414 |
| 5,763,993 | 6/1998 | Park et al. | 313/414 |
| 5,814,929 | 9/1998 | Jo | 313/414 |
| 5,869,925 | 2/1999 | Kim et al. | 313/460 |

*Primary Examiner*—Edward P. Westin
*Assistant Examiner*—Nikita Wells
*Attorney, Agent, or Firm*—Fish & Richardson P.C

[57] ABSTRACT

In a focusing electrode system in an electron gun for a color cathode ray tube, distortion of an electron beam, that takes place when horizontal and vertical diameters of a main focusing lens are different is corrected by adjusting power of a dynamic four polar lens. The system includes a first focusing electrode adapted to have applied a static voltage, and a second focusing electrode adapted to have applied a dynamic voltage synchronous to a deflection of electron beams. The second focusing electrode includes, one end having a burring part on a circumference of each of three electron beam pass-through holes at upper and lower portions thereof. A size of the burring part of the electron beam pass-through hole at a center thereof is different from a size of the burring part on each of the electron beam pass-through holes at outer portions thereof. The other end has a single electron beam pass-through hole that is identical to a single electron beam pass-through hole in one end of an anode electrode and an electrostatic field control electrode provided inside that is identical to an electrostatic field control electrode provided inside of the anode electrode. The resulting system adjusts diameters of the main focusing lenses to be formed between the second focusing electrode and the anode electrode.

8 Claims, 6 Drawing Sheets

FOCUSING ELECTRODE SYSTEM HAVING BURRING PARTS OF DIFFERING SIZES

BACKGROUND OF THE INVENTION

1. Field of the Invention

The present invention relates to an electron gun for use in a color TV or a high definition industrial picture tube, and, more particularly, to a focusing electrode system in an electron gun, in which distortion of an electron beam, which takes place when horizontal and vertical diameters of a main focusing lens are different, is corrected by adjusting power of a dynamic four polar lens.

2. Discussion of the Related Art

Being one of elements in a color cathode ray tube, the electron gun is a device in which three electron beams emitted from cathodes are focused onto a fluorescent screen coated with red, green and blue fluorescent materials inside of the cathode ray tube to generate a fluorescent light, to form a pixel.

FIG. 1 illustrates a longitudinal section of a general in-line type electron gun, and FIG. 2 illustrates a perspective view of the main focusing lens part shown in FIG. 1.

Referring to FIGS. 1 and 2, the electron gun 1 is provided with a triode part 2 for forming electron beams and a main focusing lens part 3 for focusing the electron beams. The triode part 2 is provided with cathodes 4 for emitting thermal electrons, a control electrode 5 for controlling the thermal electrodes, and an accelerating electrode 6 for accelerating the thermal electrons. The main focusing lens part 3 arranged next to the triode part 2 is provided with a focusing electrode system 7 having a first focusing electrode 71 adapted to have applied of a low static voltage, a second focusing electrode 72 adapted to have applied of a high dynamic voltage and having a burring part 723 with upper and lower parts on one end 721 thereof facing the first focusing electrode 71 on a circumference of each of three electron beam pass-through holes 722, and an anode electrode 8 arranged next to the second focusing electrode 72 and adapted to have applied a positive voltage.

Upon the aforementioned electrodes are applied the respective voltages, the electron beams are controlled and accelerated to a preset extent by the controlling electrode 5 and the accelerating electrode 6. Then, the electron beams are elongated in vertical direction by a diverging force in up and down directions of a dynamic four polar lens formed between the first and second focusing electrodes 71 and 72 both by the voltage difference between the first and second focusing electrode 71 and 72 and the burring parts 723. Then, the electron beams are converged by the main focusing lens formed by a voltage difference between the second focusing lens 72 and the anode electrode 8, finally accelerated toward the screen by the positive voltage, and deflected to a certain spot on the screen by a non-uniform magnetic field which is formed by deflection yokes for making a self convergence of the electron beams. The non-uniform magnetic field is adapted to elongate the electron beams in a horizontal direction, forming a haze, a thin dispersion of an image, of the electron beam spot on the screen in up and down directions. However, as explained, since the electron beams have been elongated in the vertical direction already before incident to the main focusing lens by the dynamic four polar lens, the horizontal elongation of the electron beams by the non-uniform magnetic field after incident to the main focusing lens is prevented, to form an electron beam spot of a well rounded circle on the screen. Further, as the size of the main focusing lens is the larger, the main focusing lens between the second focusing electrode 72 and the anode electrode 8 reduces the spherical aberration more, to form the electron beams that spot more clear. In general, the size of the main focusing lens is proportional to sizes of electron beam pass-through holes on opposite ends of the second focusing electrode and the anode electrode.

FIG. 2 illustrates track formed electron beam pass-through holes 725 and 825 formed on the opposite ends, 724 and 824, respectively, of the second focusing electrode 72 and the anode electrode 8 adapted to pass the three electron beams in common for implementing large sized electron beam pass-through holes 725. In order to prevent the main focusing lens from having a horizontal diameter greater than a vertical diameter by shapes like the electron beam pass-through holes 725 and 825, large aperture lens with blade (L-B lens, hereinafter electrostatic field control electrode) 91 and 92 are provided inside of the second focusing electrode 72 and the anode electrode 8. Each of the electrostatic field control electrodes is provided with an electron beam pass-through hole 911 and 921 at a center thereof and blades 912 and 922 of each with a certain width bent at a right angle on both ends thereof. Each of the blades 912 and 922 adapted to be disposed between the three electron beams forms an additional lens so that a horizontal direction converging strength of the main focusing lens is reinforced for preventing the main focusing lens from having a horizontal diameter greater than a vertical diameter, thereby allowing to form three large sized main focusing lenses each of which has a spherical aberration less than the main focusing lens formed by known three electron beam pass-through holes. However, when a diameter of the main focusing lens at the center is compared to a diameter of the outer main focusing lenses, it can be known that virtual effective diameters of the main focusing lenses at the center and at outer portions are different from each other.

FIG. 3 illustrates a graph showing relations between an electron beam diverging angle and an electron beam radius at an outlet of the main focusing lens, from which virtual effective diameters of the main focusing lenses can be calculated according to a known method, wherein the closer the lines to a non-aberration line (the straight line in FIG. 3), the greater the diameter of the lens. The calculation of diameters of the main focusing lenses according to the graph shows that the diameters of the main focusing lens at the center CV and at the outer portions SV in vertical direction are the same 8 mm, and the diameters of the main focusing lens at the center CH and at the outer portions SH in horizontal direction are 7.5 mm and 7 mm respectively, the horizontal diameters SH at the outer portions being smaller than the horizontal diameter CH at the center. This implies that the horizontal diameters SH at the outer portions are influenced by the spherical aberration more than the horizontal diameter CH at the center. In the case when there is no size difference between the horizontal diameters CH and SH of the main focusing lenses at the center and at the outer portions and between the vertical diameters CV and SV of the main focusing lenses at the center and at the outer portions, as shown in FIG. 4A, voltages of the electron beam spot in horizontal and vertical directions measured on the screen when the electron beam is deflected in 3 o'clock or 9 o'clock direction of the screen (hereinafter called "horizontal direction") show no changes in the horizontal direction and an exponential rise in the vertical direction. This is because, as explained before, the horizontal direction voltage comes from the first focusing electrode 71 to which is applied a static voltage that has no changes in voltage and the vertical direction voltage comes from the second focusing electrode 72 to which is applied a dynamic voltage that is changed depending on an amount of deflection of the electron beams to be made. However, as shown in FIG. 4B, in case there is a great size difference between the horizontal diameter SH and vertical diameter SV of the main focusing lens at the outer portions due to the electrostatic field control electrodes 91 and 92, the horizontal direction voltage of the electron beams measured on the screen gradually rises when the electron beams are deflected in the horizontal direction of the screen even if the first focusing electrode 71 is applied the static voltage while the vertical direction voltage rises exponentially. FIG. 4C shows halos in the horizontal direction caused by horizontal over convergencies of the outer electron beams. The halo gives bad effect to the resolution in the periphery of the screen.

SUMMARY OF THE INVENTION

Accordingly, the present invention is directed to a focusing electrode system in an electron gun for a cathode ray tube that substantially obviates one or more of the problems due to limitations and disadvantages of the related art.

An object of the present invention is to provide a focusing electrode system in an electron gun for a cathode ray tube which can prevent distortion of electron beams taking place when horizontal and vertical diameters of a main focusing lens are different.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the focusing electrode system includes a first focusing electrode adapted to have applied a static voltage, and a second focusing electrode adapted to have applied a dynamic voltage synchronous to a deflecton of electron beams, the second focusing electrode including, one end having a burring part on a circumference of each of three electron beam pass-through holes at upper and lower portions thereof, a size of the burring part on the electron beam pass-through hole at a center thereof being different from a size of the burring part on each of the electron beam pass-through holes at outer portions thereof, and the other end having a single electron beam pass-through hole therein identical to a single electron beam pass-through hole in one end of an anode electrode and an electrostatic field control electrode provided inside thereof identical to an electrostatic field control electrode provided inside of the anode electrode, thereby adjusting diameters of main focusing lens to be formed between the second focusing electrode and the anode electrode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
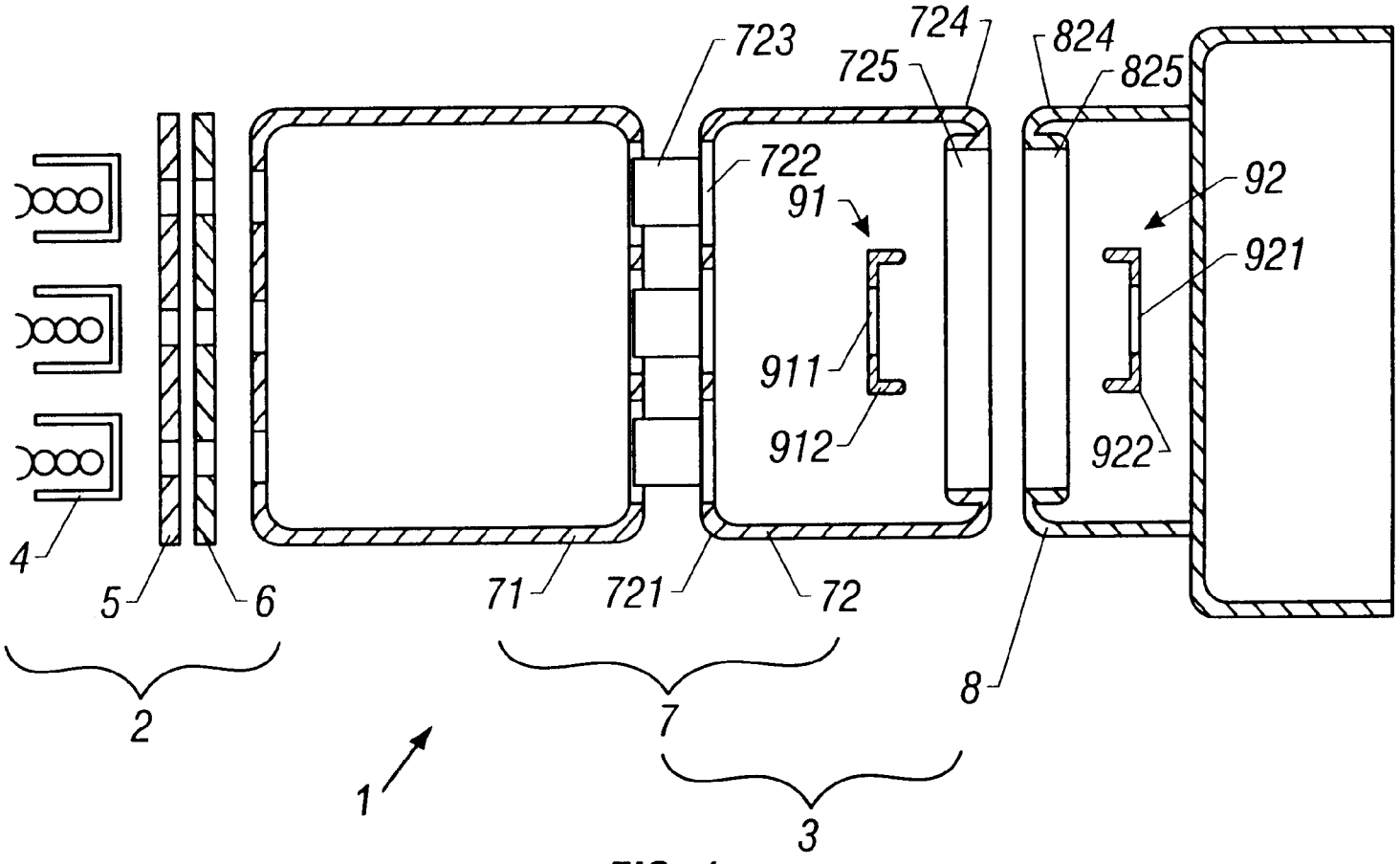
FIG. 1 (Prior Art)
FIG. 1 illustrates a longitudinal section of a general in-line type electron gun.
Figure 2:
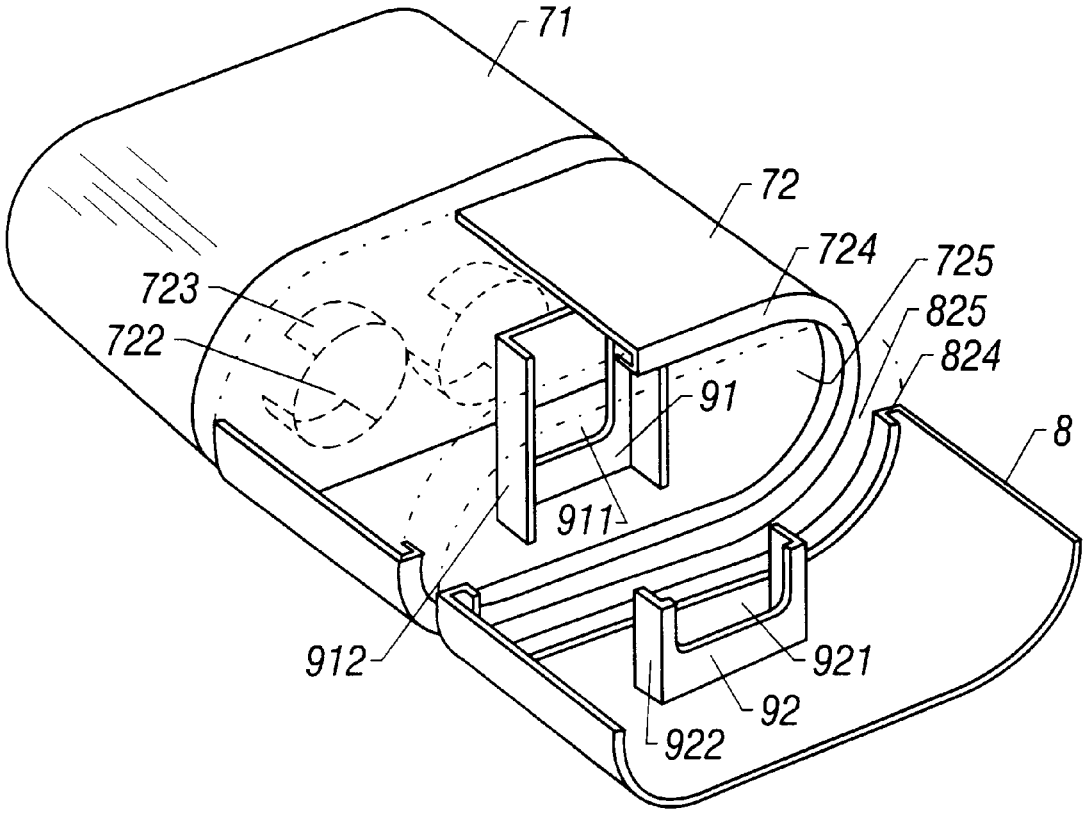
FIG. 2 (Prior Art)
FIG. 2 illustrates a perspective view of the main focusing lens part shown in FIG. 1.
Figure 3:
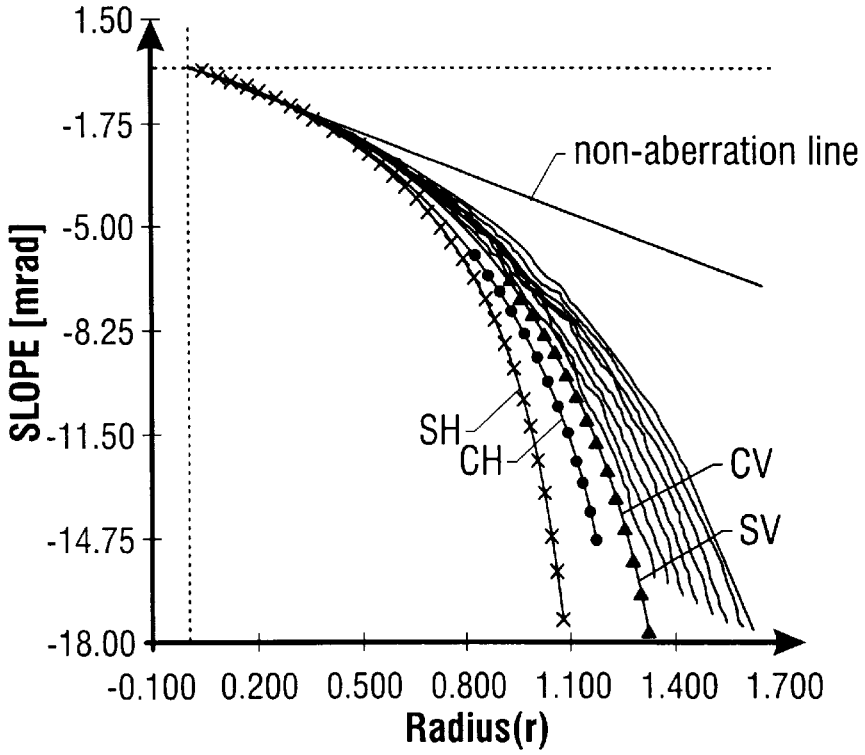
FIG. 3 (Prior Art)
FIG. 3 illustrates a graph showing relations between an electron beam diverging angle and an electron beam radius at an outlet of the main focusing lens, from which virtual effective diameters of the main focusing lenses can be calculated according to a known method.
Figure 4A:
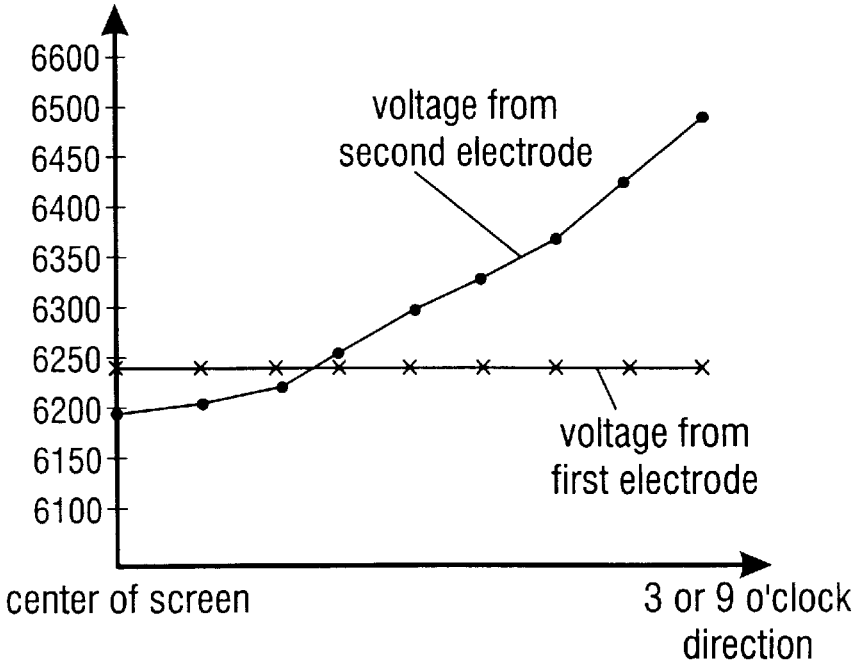
FIG. 4A (Prior Art)
FIG. 4A illustrates a graph showing a voltage change of an electron beam in horizontal direction measured on a screen in case there is no distortion in a main focusing lens.
Figure 4B:
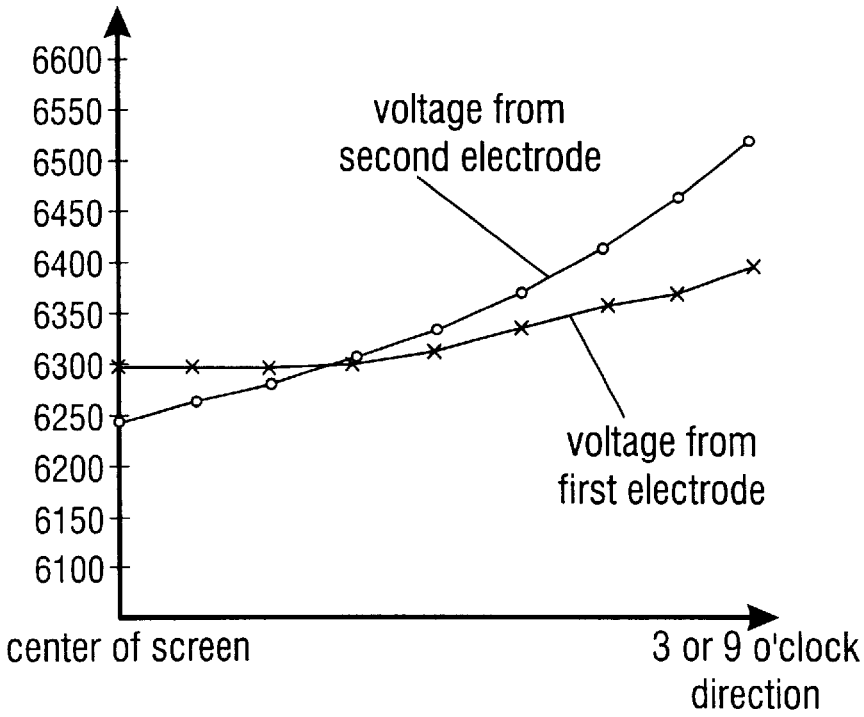
FIG. 4B (Prior Art)
FIG. 4B illustrates a graph showing a voltage change of an electron beam in horizontal direction measured on a screen in case there is distortion in a main focusing lenses at outer portions.
Figure 4C:
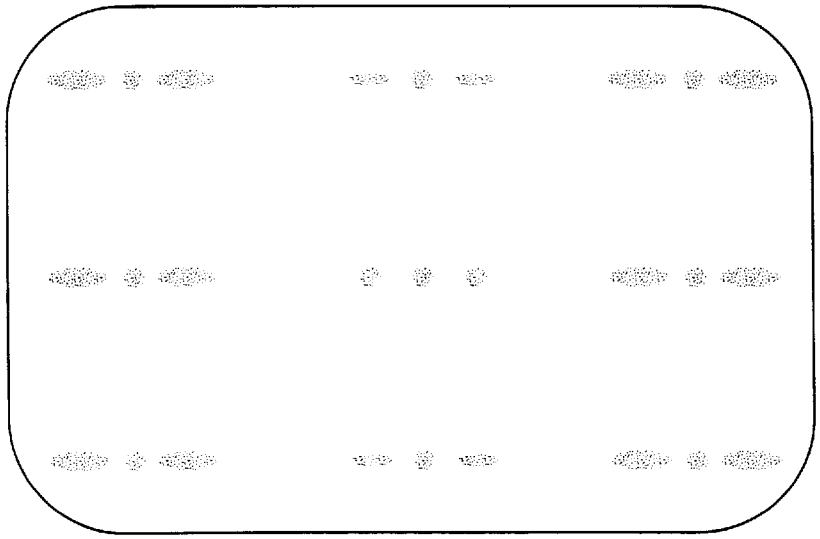
FIG. 4C (Prior Art)
FIG. 4C illustrates examples of horizontal halos caused by horizontal over convergencies of the outer electron beams.
Figure 5A:
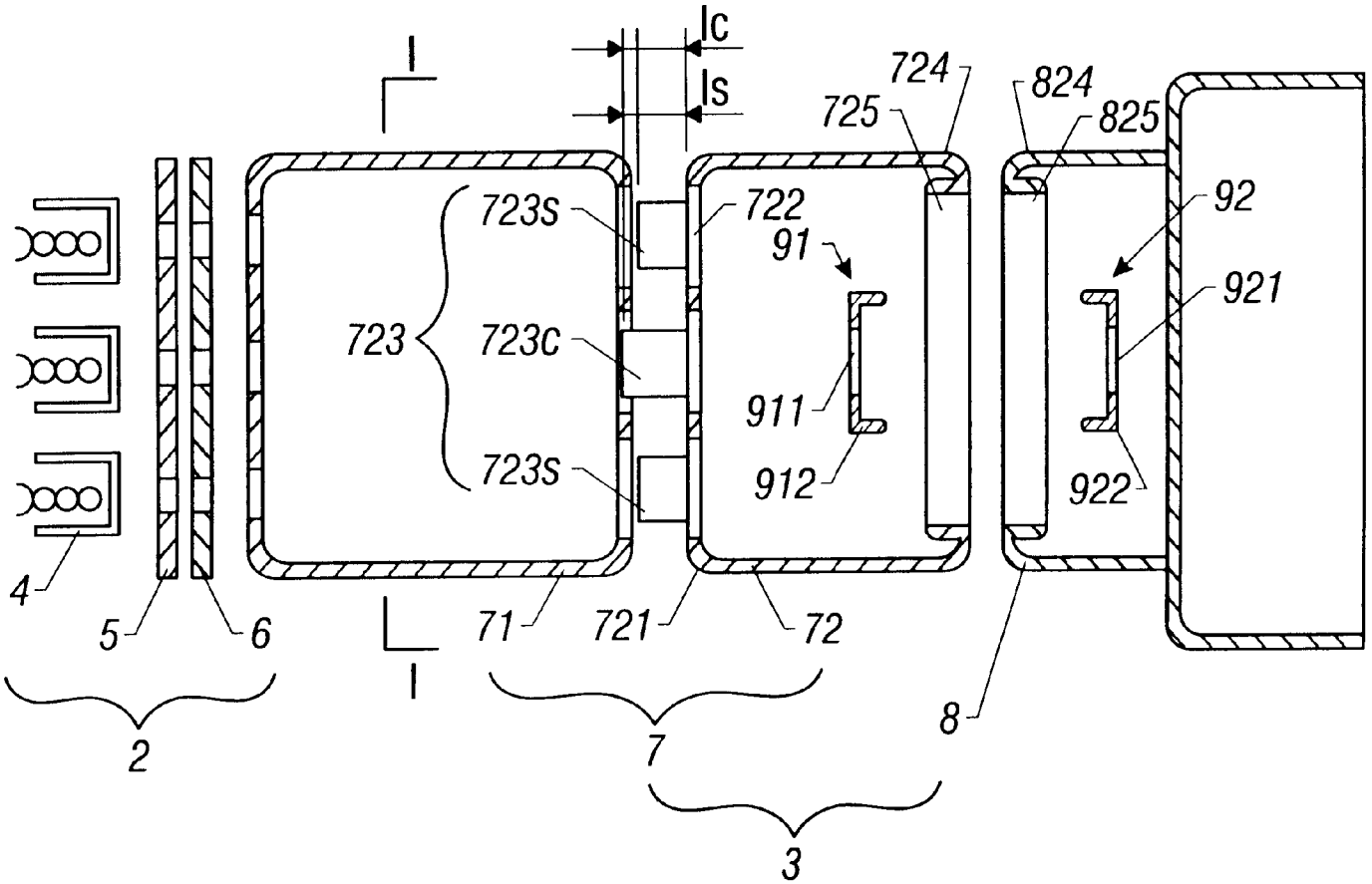
FIG. 5A illustrates a longitudinal section of an electron gun for a color cathode ray tube showing a focusing electrode system in accordance with a second preferred embodiment of the present invention.
Figure 5B:
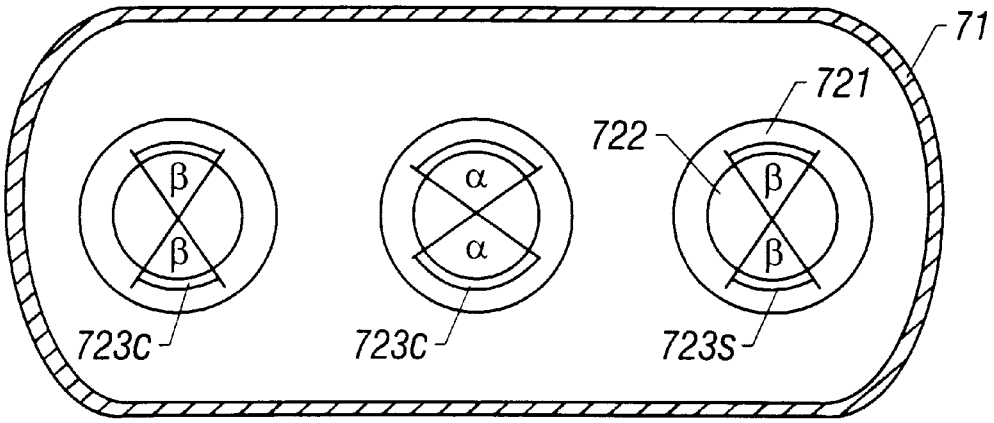
FIG. 5B illustrates a section across line I—I in FIG. 5A for showing a focusing electrode system in accordance with a first embodiment of the present invention.

Reference will now be made in detail to the preferred embodiments of the present invention, examples of which are illustrated in the accompanying drawings. FIG. 5A illustrates a longitudinal section of an electron gun for a color cathode ray tube showing a focusing electrode system in accordance with a second preferred embodiment of the present invention and FIG. 5B illustrates a section across line I—I in FIG. 5A for showing a focusing electrode system in accordance with a first embodiment of the present invention. As there is no structural change in the present invention except the burring parts on the conventional second focusing electrode, the same reference numbers will be given for the parts identical to the conventional one, and explanations on the identical parts will be omitted.

Figure 6:
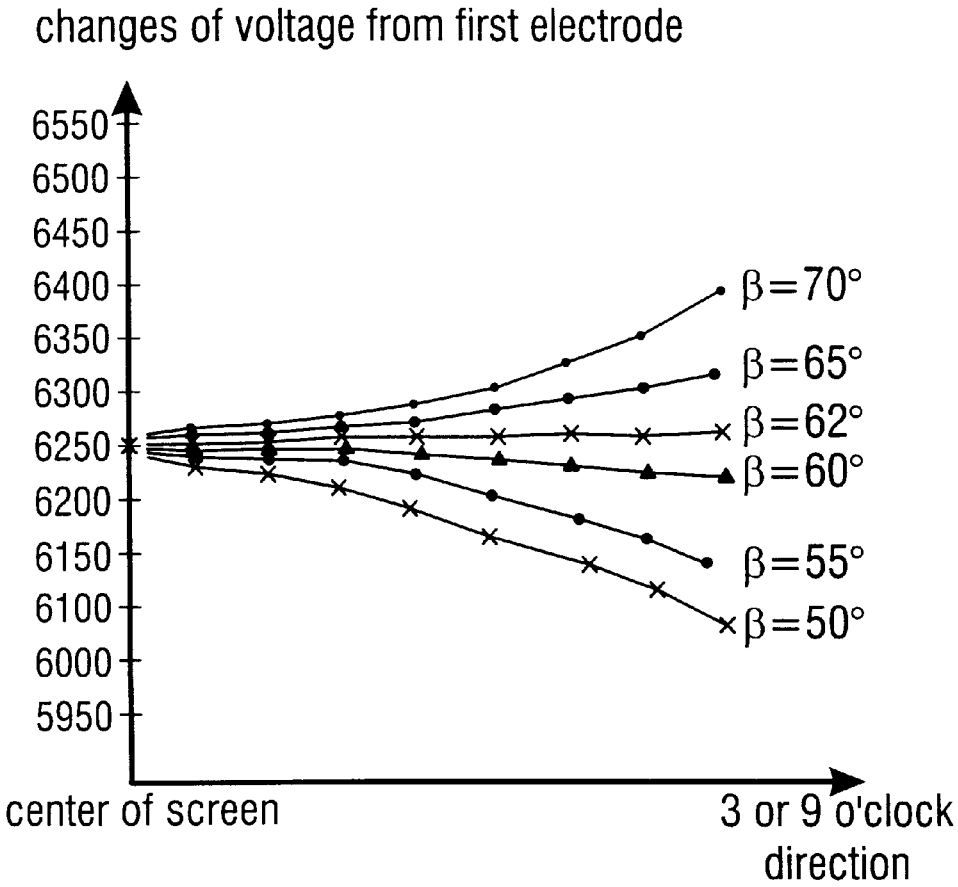
FIG. 6 illustrates a graph showing changes of voltage of an electron beam in a horizontal direction measured on a screen according to changes of a width of an outer burring part while a width of a center burring part and lengths of center and outer burring parts are fixed.

In the focusing electrode system 7 in an electron gun for a color cathode ray tube in accordance with the present invention, a size of a burring part 723 is made different between a center burring part 723C and outer burring parts 723S to make strengths of dynamic four polar lenses formed between the first and second focusing electrodes 71 and 72 different from one another, for forming sizes of a horizontal diameter SH and a vertical diameter SV of the outer main focusing lens the same. That is, when sizes of the outer burring parts 723S are defined appropriately, resulting in the sizes of the outer burring parts 723S being different from the size of the center burring part 723, adjusting a weakening of the diverging effect of the outer electron beams in a vertical direction, the horizontal diameters SH and the vertical diameters SV of the outer main focusing lenses formed by the electrostatic field control electrodes 91 and 92 can be made the same. The appropriate sizes of the burring parts 723C and 723S, a width and a length of each of the burring part 723C or 723S can be found according to the following method. Herein, the width of burring part 723C or 723S is an angle α or β at the center of the electron beam pass-through hole 722 formed by an arc of the burring part 723C or 723S, and a length 1*c* or 1*s* of the burring part 723C or 723S is a distance from the end 721 face of the second focusing electrode 72 to a free end of the burring part 723C or 723S projected toward the first focusing electrode 71. The first embodiment of the present invention, as illustrated by the focusing electrode system in FIG. 5B, shows that the width of the outer burring part 723S on top and bottom of the electron beam pass-through hole 722 in the second focusing electrode 72 is narrower than the same of the center burring part 723C. An optimal width of the burring part 723C or 723S in this embodiment can be found in the following method. As the electron beam is almost not distorted by the center main focusing lens formed by the conventional electrostatic field control electrode, the width of the outer burring part 723S is gradually reduced while the width of the center burring part 723C and the lengths 1*c* and 1*s* of the center and outer burring parts 723C and 723S are fixed until they are at a width at which the electron beam spot is not distorted is found. For example, when the angle a of the center burring part 723C is fixed at 70° and both the lengths 1*c* and 1*s* of the center and outer burring parts 723C and 723S are fixed at 0.7 mm, the optimal width, i.e., optimal angle β of the outer burring part 723S is 60°~65°. FIG. 6 illustrates a graph showing changes of voltage of the electron beam in the horizontal direction measured on the screen, according to changes of the width of the outer burring part 723S while the width of the center burring part 723C and lengths 1*c* and 1*s* of center and outer burring parts 723C and 723S are fixed. It has been found from an experiment that a change in the order of ±50 V gives no significant influence to a resolution at a periphery of the screen when a fabrication error is taken into consideration.

FIG. 5A illustrates a longitudinal section of an electron gun for a color cathode ray tube showing the focusing electrode system in accordance with a second preferred embodiment of the present invention, wherein the length 1*s* of the outer burring part 723S is shown shorter than the length 1*c* of the center burring part 723C. An optimal length of the burring part can be found using a method similar to the method of the first embodiment. In this case of embodiment, the length 1*s* at which the outer electron beam spot exhibits no distortion can be found by changing the length 1*s* of the outer burring part 723S while the center burring angle α and the outer burring angle β are fixed at 70°, identical to each other, and the length 1*c* of the center burring part 723C is fixed at 0.7 mm. The length 1*s* obtaine is in a range of 0.6~0.65 mm. The trend of horizontal direction voltage change of the electron beam spot measured on the screen while changing the length 1*s* of the outer burring parts 723S and keeping the width and length 1*c* of the center burring part 723C constant is almost identical to the trend of horizontal direction voltage change of the electron beam spot measured on the screen while changing the burring angles α and β as the first embodiment.

Though it has been shown that only the width or the length of the outer burring part is adjusted in the first and second embodiments of the present invention, it is evident that the width and length of the outer burring part also can be adjusted at the same time to accord to conditions of design from the first and second embodiments of the present invention.

It will be apparent to those skilled in the art that various modifications and variations can be made in the focusing electrode system in an electron gun for a color cathode ray tube of the present invention without departing from the spirit or scope of the invention. Thus, it is intended that the present invention cover the modifications and variations of this invention provided they come within the scope of the appended claims and their equivalents.

What is claimed is:

1. A focusing electrode system in an electron gun for a color cathode ray tube comprising: a first focusing electrode adapted to have applied a static voltage, and, a second focusing electrode adapted to have applied a dynamic voltage synchronous to a deflection of electron beams, the second focusing electrode including, a first end having three electron beam pass-through holes, including a center hole and two outer holes, wherein a burring part is formed on a circumference of each of the three electron beam pass-through holes, and a size of the burring part on the center electron beam pass-through hole differs from a size of the burring part of each of the outer electron beam pass-through holes, and a second end having a single electron beam pass-through hole therein identical to a single electron beam pass-through hole in one end of an anode electrode and an electrostatic field control electrode provided inside thereof identical to an electrostatic field control electrode provided inside of the anode electrode, wherein each electrostatic field control electrode includes an electron beam pass-through hole at its center and blades bent at right angles on each end, thereby adjusting diameters of main focusing lenses to be formed between the second focusing electrode and the anode electrode.

2. A focusing electrode system as claimed in claim 1, wherein the size of each of the burring parts as the outer holes is smaller than the size of the burring part at the center hole.

3. A focusing electrode system as claimed in claim 2, wherein an angle at a center of each of the outer electron beam pass-through holes formed by an arc of the burring part of the outer electron beam pass-through hole is smaller than an angle at a center of the center electron pass-through hole.

4. A focusing electrode system as claimed in claim 3, wherein the angle of each of the burring parts at the outer holes is 86 to 92% of the angle of the burring part at the center hole.

5. A focusing electrode system as claimed in claim 3, wherein the angle of each of the burring parts at the outer portions is 60 to 65° and the angle of the burring part at the center hole is 70°.

6. A focusing electrode system as claimed in claim 2, wherein the length to a free end of each of the burring parts at the outer holes is shorter than a length to a free end of the burring part at the center hole.

7. A focusing electrode system as claimed in claim 6, wherein the length of each of the burring parts at the outer holes is 86 to 92% of the length of the burring part at the center hole.

8. A focusing electrode system as claimed in claim 6, wherein the length of each of the burring parts at the outer holes is 0.6 to 0.65 mm, and the length of the burring part at the center hole is 0.7 mm.

* * * * *